United States Patent [19]

Carlsson, Jr. et al.

[11] 4,049,277

[45] Sept. 20, 1977

[54] BUBBLE FREE DIE AGITATOR

[75] Inventors: Ernest R. Carlsson, Jr., Huntington; Henry Delach, Bethpage; Henry Hinz, Huntington, all of N.Y.

[73] Assignee: Ideal Toy Corporation, Hollis, N.Y.

[21] Appl. No.: 610,355

[22] Filed: Sept. 4, 1975

[51] Int. Cl.[2] ..... A63F 9/04; B65D 1/04

[52] U.S. Cl. ..... 273/145 C; 215/6; 273/1 L

[58] Field of Search ..... 273/145 R, 145 A, 145 B, 273/145 C, 145 CA, 145 D, 145 E, 144 B, 144 A, 144 R, 1 L, 86 H, 86 A, 58 H, 138 R; 272/8 N; 46/91, 92, , 93, 94, , 95, 96, 11, 41, 42; 215/6, 1 R, 1 C; 40/106.21, 106.22, 106.25

[56] References Cited

U.S. PATENT DOCUMENTS

| | | | |
|---|---|---|---|
| 55,341 | 6/1866 | Morse | 215/6 |
| 163,851 | 6/1895 | Demuth | 272/8 N |
| 197,542 | 11/1877 | Carman | 215/6 |
| 591,619 | 10/1897 | Broemler | 215/6 |
| 635,204 | 10/1899 | Taylor | 215/6 X |
| 842,218 | 1/1907 | Marsh | 215/1 R |
| 1,865,023 | 6/1932 | Leavy | 215/6 UX |
| 2,126,465 | 8/1938 | Hilgenberg | 215/1 R |
| 2,144,857 | 1/1939 | Schultz | 46/41 UX |
| 2,746,757 | 5/1956 | Frost | 273/145 C X |
| 3,049,226 | 8/1962 | Schurr | 215/6 UX |
| 3,119,621 | 1/1964 | Bookman | 273/145 C |

FOREIGN PATENT DOCUMENTS

| | | | |
|---|---|---|---|
| 337,747 | 2/1904 | France | 273/138 R |
| 4,616 | 3/1900 | United Kingdom | 215/6 |
| 3,127 | 2/1907 | United Kingdom | 215/6 |
| 1,106,633 | 3/1968 | United Kingdom | 215/6 |
| 481 | 1/1900 | United Kingdom | 273/144 B |

*Primary Examiner*—Richard C. Pinkham
*Assistant Examiner*—Arnold W. Kramer
*Attorney, Agent, or Firm*—Richard M. Rabkin

[57] ABSTRACT

An amusement device, such as a die agitator, includes a closed liquid tight container having opposed end portions and a partition member located therein which divides the container into first and second chambers, with the first chamber being of greater volume than the second chamber. The partition member has an opening formed therein providing communication between the chambers and liquid fills the first chamber and a portion of the second leaving an air space or bubble in the second chamber. A buoyant game piece or die provided in the first chamber is used in the play of the game. The bubble in the second chamber accomodates expansion of the liquid in the container but is trapped in the second container so that it does not enter the first chamber.

6 Claims, 6 Drawing Figures

BUBBLE FREE DIE AGITATOR

The present invention relates to an improved amusement device, and in particular to an improved liquid filled die agitator type of amusement device.

Liquid filled die agitators of various types are provided in the prior art, such as for example the agitators shown in U. S. Pat. Nos. 3,119,621 and 3,168,315 to Bookman and 1,538,455 to Winkel. Such agitators usually consist simply of a liquid filled container including a buoyant game piece or multi-faceted die therein which has informative indicia on each of its faces. These agitators must be completely filled with liquid in order to operate satisfactorily, since any air bubbles in the agitator container will rise with the die to the surface of the container through which the die is viewed thereby allowing the observer to see the die rather than just the caption or indicia on the die. As a result the "mystery" associated with the appearance of the caption on the die is reduced or eliminated. For this reason the agitators are usually filled while immersed in the filling liquid, in order to avoid the formation of bubbles. Alternatively, the containers are provided with a flexible diaphragm, such as is suggested in U.S. Pat. No. 3,168,315, in order to maintain the liquid under a small negative pressure at ordinary temperatures, thereby to keep the interior of the agitator free of internal bubbles. Obviously, manufacturing die agitators by either of these methods substantially increases the manufacturing costs since additional labor and time, as well as additional expensive materials are required.

Accordingly, it is an object of the present invention to provide a die agitator which is relatively simple and yet rugged in construction.

Another object of the present invention is to provide a die agitator in which the die is retained in a bubble free chamber.

A further object of the present invention is to provide a die agitator which is entirely formed of relatively rigid materials, but which contains a chamber including an air space which accommodates expansion and contraction of the liquid container within the agitator as a result of a variance in surrounding temperature.

In accordance with an aspect of the present invention a die agitator or amusement device is provided which includes a relatively transparent plastic container having open and closed end portions. A cover is secured, in any convenient manner, to the open end portion of the container in a liquid tight sealing relation, while a partition member is mounted in the container adjacent the open end thereof to divide the container into first and second chambers. The partition is generally frust-conically shaped and has its greater base secured to the inner walls of the container, with its smaller base located in the second chamber in slightly spaced relation to the cover. This smaller base has an opening formed therein that provides fluid communication between the two chambers. A buoyant member, such as for example a die having game indicia formed thereon, is located in the first chamber.

Liquid is provided in the container in an amount sufficient to fill the first chamber and a portion of the second chamber. As a result, when the cover is sealed to the container an air space or gas bubble is formed in the second chamber that accommodates expansion and contraction of the liquid as a result of varying temperatures. However, this gas bubble is trapped in the second chamber during tilting or inversion of the container during play of the game, so that the bubble does not enter the first chamber and interfere with the movement of the buoyant game die in the first chamber. As a result of this construction, the container is readily assembled, without the requirement of previously proposed devices that it be immersed in the filling liquid during the assembly procedure.

The above, and other objects, features and advantages of the present invention, will be apparent in the following detailed description of an illustrative embodiment thereof, which is to be read in connection with the accompanying drawings, wherein.

Figure 4:
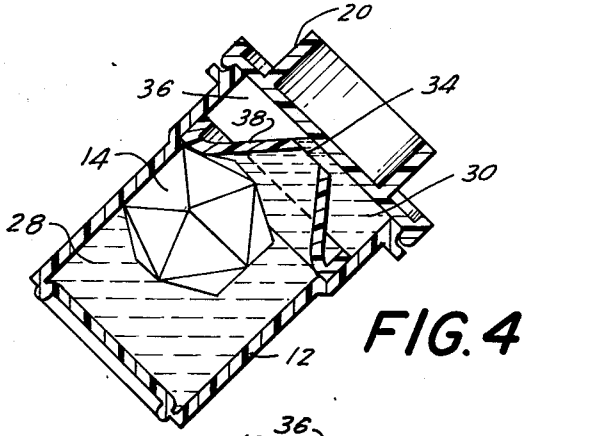
Figure 5:
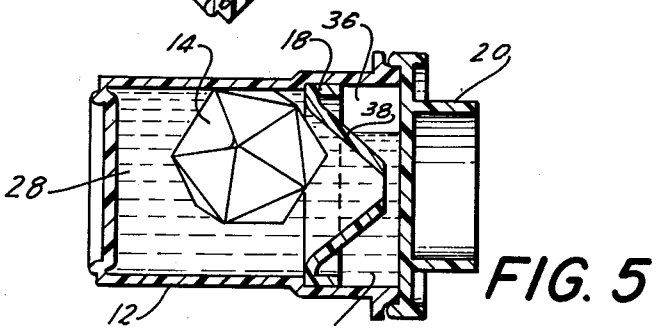
Figure 6:
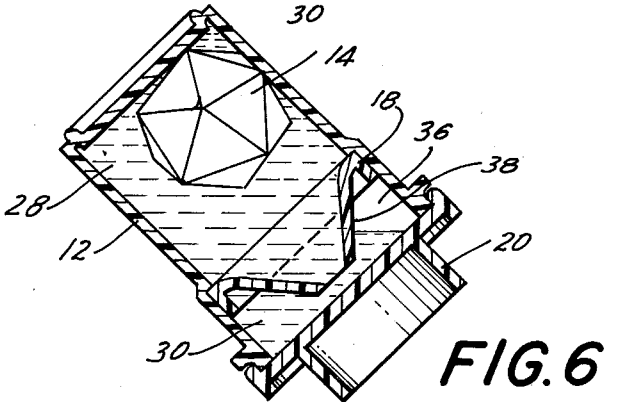
Figure 2:
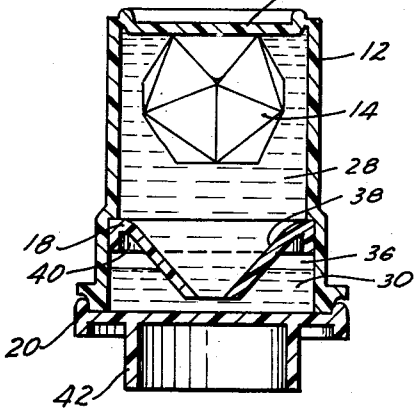
FIG. 2 is an elevational view, in section, of the assembled die agitator as placed in its inverted position during play of a game.
Figure 3:
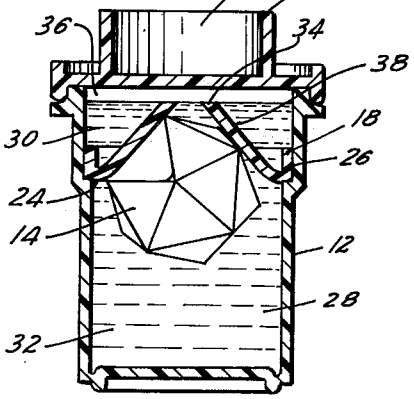

FIG. 3 is a sectional view, similar to FIG. 2, showing the die agitator in its normal upright position during storage and between plays in the course of the game; and FIGS. 4–6, are sequential sectional views showing the configuration of the agitator and the liquid contained therein, at various positions during inversion of the agitator from the position shown in FIG. 3 to the position shown in FIG. 2.

Figure 1:
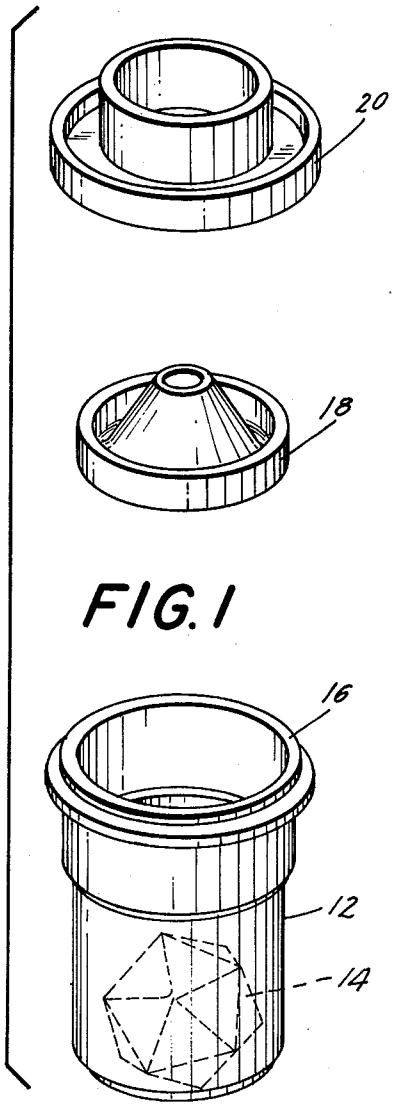
FIG. 1 is an exploded perspective view of an amusement device or a die agitator constructed in accordance with the present invention.

Referring now to the drawing in detail, and initially to FIG. 1 thereof, it is seen that a die agitator 10, constructed in accordance with the present invention consists of a container 12 in which a buoyant die member 14 is positioned. The container has an opened upper end 16 through which an apertured partition member 18 is inserted in order to divide the container into first and second separate chambers. The open end 16 of the container is then closed by a cover 20, as described hereinafter. Each of elements 12, 18 and 20 is formed of a relatively rigid transparent plastic material of any suitable composition. Prior to placement of cover 20 on container 12, the container is substantially filled with liquid to a predetermined level with respect to partition member 18. This liquid preferably is opaque, in order to contrast with indicia formed on the facets of die 14. In use, the assembled agitator is normally maintained in the position shown in FIG. 3, and the players "ask" the agitator a question. The agitator then is inverted from the position shown in FIG. 3 to the position shown in FIG. 2, whereby die 14, because of its buoyancy with respect to the liquid in the container, rises upwardly and one of its facets engages the transparent base wall 22 of container 12. The indicia on the facet of the die which engages surface 22 is visible therethrough, in the manner described in the above mentioned Bookman references, so as to be read by the players.

The construction of die agitator 10 is such as to allow the agitator to be filled and sealed with cover 20 relatively rapidly and without immersion in the filling liquid, while at the same time providing for expansion of the liquid in the container, without the creation of bubbles that would interfere with the movement of the die 14.

Referring to FIG. 3 of the drawing, it is seen that container 12 has an annular inner shoulder 24 formed therein on which partition member 18 is seated. The partition member is generally frust-conical in shape and has an external flange 26 formed adjacent its greater base. This flange sits on shoulder 24 and is sealed to the inner wall of the container in any convenient manner, as for example by a heat seal or an adhesive. By positioning the partition member in this manner, the interior of container 12 is divided into a first chamber 28 and a second chamber 30. The buoyant game piece or die 14 is initially positioned in the container before partition 18 is placed therein, so that it is trapped within chamber 28.

After partition 18 is in place, container 12 is filled (in the upright position shown in FIG. 3) with liquid 32 to a predetermined level in order to completely fill chamber 28 and a portion of chamber 30. The amount of liquid used to fill the container is selected such that the opening 34 in partition 18 is covered with liquid when the conical surface of the partition is horizontal, as seen in FIG. 4, so that the bubble cannot escape upwardly into chamber 28. Thereafter cover 20 is placed on the open upper edge 16 of the container and is secured thereto in a liquid tight seal, as for example by a heat seal or a suitable adhesive.

By filling container 12 in this manner an air space 36 is formed in chamber 30. This air space defines, in effect, a bubble within the container. However, because the container is filled with a predetermined amount of liquid, as described above, opening 34 is sealed off by liquid as the container is inverted so that the bubble is retained within chamber 30 and does not enter chamber 28. Accordingly, when agitator 10 is inverted, from the position shown in FIG. 3 to the position shown in FIG. 2, the air space or bubble 36 will remain within the chamber 30, as seen in FIGS. 4–6. That is, as the container is tilted the liquid within chamber 30 moves to "seek its own level" to the lowermost position within that chamber. The bubble or air space 36 similarly tends to move to the upper portion of the chamber as the container is tilted. Because of the volume of liquid in chamber 30 the opening 34 in partition member 18 is thus always immersed within the fluid and air bubble 36 therefore cannot enter through opening 34 into chamber 28.

As the container is further tilted (from the 90° tilted position of FIG. 5 through the position of FIG. 6 to the position of FIG. 2) air bubble 36 is displaced by the liquid 32 in chamber 30 continuously upwardly and the bubble thus is urged around the frust-conical wall portion 38 of parition 18 into the annular channel 40 defined around frusto-conical portion 38 and the interior side wall of container 12. Accordingly, bubble 36 forms what, in effect, is a toroidally shaped bubble in chamber 30, as illustrated in FIG. 2. The bubble cannot then escape through partition member 18 into chamber 28 to interfere with movement of die 14, since the pressure on the liquid in chamber 30 as a result of the pressure head of liquid in chamber 28 is either equal to or greater than the gas pressure in the air bubble itself. Thus the bubble is trapped within chamber 30.

As shown in FIG. 2, in the inverted position of the agitator, it is seated on a pedestal 42 formed integrally with the cover 20.

The air space or bubble 36 formed in the container serves to accommodate expansion of the liquid 32 as a result of temperature changes in the surrounding area. Preferably the device is filled as close as possible to the top of container 12 so that the bubble or air space is small. However, at a minimum, the container should be filled with an amount of liquid such that, in the position of FIG. 4, the parition opening 34 is immersed in liquid, in order to insure that the air bubble does not escape through the partition member into chamber 28.

Of course, it will be apparent that in the event that a portion of the air bubble 36 does escape into the chamber 28, because the device is agitated excessively by the players, or for any other reason, when the container is returned to its upright position shown in FIG. 3, any gas bubbles in chamber 28 will move upwardly, because of their buoyancy, and be directed by partition member 18 towards opening 34 into chamber 30 where they will again become trapped.

Accordingly, it will be appreciated that a relatively simply constructed die agitator or amusement device has been provided which is both durable in construction and adapted to be fabricated with a minimum of labor, parts and difficulty.

Although an illustrative embodiment of the present invention has been described herein with reference to the accompanying drawings, it is to be understood that the invention is not limited to that precise embodiment and that various changes and modifications can be effected therein by those skilled in the art, without departing from the scope of spirit of this invention.

What is claimed is:

1. A die agitating amusement device comprising, a closed liquid tight container having opposed first and second end portions, said second end portion having a substantially flat transparent section therein; a liquid impervious partition member in said container located adjacent said first end portion thereof, said partition extending across the entire crossection of said container thereby dividing the container into first and second chambers, with the first chamber being of greater volume than the second chamber and located between the second end portion of the container and said partition; said second chamber being located opposite said first chamber between said partition and said first end portion of the container, said partition member having a centrally located extension portion which extends into said second chamber towards said first end portion of the container and an opening in said extension portion providing the sole fluid communication between said chambers, an opaque liquid filling said first chamber and a portion of said second chamber, the volume of liquid in said container being selected to entirely fill said first chamber and a portion of the second chamber to keep said opening immersed in liquid regardless of the position of the container whereby any air in said second chamber accommodates expansion of the liquid while the first chamber remains completely filled with liquid and any gas bubble defined by such air remains trapped in the container in said second chamber upon tilting or inversion of the container; and a buoyant die member located in said first chamber and having indicia formed thereon in a color contrasting with the color of said liquid whereby said indicia can be read through said second end portion of the container when said second end portion is above said first end portion but said buoyant member is blocked by said partition when said first end portion is above said second end portion.

2. The device as defined in claim 1 wherein the volume of liquid in said container is selected such that when the container is positioned with said second chamber above the first chamber the liquid entirely fills the first chamber and a portion of the second chamber to at least the level of said opening.

3. The device as defined in claim 2 wherein said partition is generally frusto-conical in shape and has its greater base secured in liquid tight relation to the container and the tapered generally conical walls thereof extending into said second chamber, with said opening defining the smaller base thereof.

4. A die agitating amusement device comprising a container having open and closed end portions, a cover secured to said open end portion of the container in liquid tight sealing relation, said closed end portion including a transparent viewing section, a liquid impervious partition member mounted in said container adjacent one end thereof and extending across the entire cross-section of the container dividing said container into first and second chambers respectively located between said closed end and the partition and between the cover and the partition, with said first chamber being of greater volume than said second chamber, said partition member having a centrally located extension portion extending into said second chamber towards said cover and an opening in said extension portion providing the sole fluid communication between said chamber, liquid filling said first chamber and a portion of said second chamber when the container is seated on said closed end thereby to define an air space in said second chamber to accommodate expansion of the liquid and trap any gas bubble within the container in said second chamber, the volume of liquid in said container being selected to close the opening in said partition at all positions during inversion of the container from a position wherein said cover is located above said closed end portion to a position wherein said closed end portion is above said cover thereby to prevent escape of the gas bubble from the second chamber into the first chamber; and a buoyant die member having indicia thereon located in said first chamber, said die member having a different color than said liquid whereby said indicia can be read through said viewing section of the closed end portion of the container when said closed end portion is above said cover, but is invisible to view through the container when said cover is above said closed end as the die member is held away from said cover of the container by the partition.

5. A die agitating amusement device including a container having open and closed end portions, said closed end portion including a transparent viewing section, a cover secured to the open end portion of the container in liquid tight sealing relation, a separately formed liquid impervious partition member mounted in said container adjacent the open end thereof and extending across the entire cross-section of the container dividing the container into first and second chambers respectively located between said closed end and the partition and between said cover and the partition said partition being generally frusto-conical in section having its greater base secured to the inner walls of the container and its smaller base located in said chamber in slightly spaced relation to said cover closer to said cover than said greater base, said smaller base having a centrally located opening therein providing the sole fluid communication between said chambers, a buoyant die member located in said first chamber having game indicia thereon, and a liquid, having a different color than said die member, in said container filling said first chamber and a predetermined portion of said second chamber to a predetermined level when the container is in a first position wherein said cover is above said closed end to define an air space in said second chamber to accommodate expansion of the liquid and trap any gas bubble within said second chamber and to immerse the opening in said partition member during inversion of the container from said first position, wherein the cover is above said closed end, to a second position wherein said closed end is above said cover, whereby the gas bubble in said second chamber is trapped therein during tilting or inversion of the container from said first to said second position while the indicia on the buoyant member can be read through said viewing section of said closed end portion when the container is in said second position and is invisible to view through the container when the container is in said first position as the die is held away from said cover by said partition.

6. The device as defined in claim 5 wherein said container is generally cylindrical and has an inner annular shoulder formed on its inner wall, said greater base of the frustro-conical partition member being seated on said shoulder.

* * * * *